US006979984B2

(12) United States Patent
Perrier et al.

(10) Patent No.: US 6,979,984 B2
(45) Date of Patent: Dec. 27, 2005

(54) METHOD OF FORMING A LOW QUIESCENT CURRENT VOLTAGE REGULATOR AND STRUCTURE THEREFOR

(75) Inventors: Stephane Perrier, Bernin (FR); Patrick Bernard, Saint Martin le Vinoux (FR); Pierre Daude, Grenoble (FR)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 28 days.

(21) Appl. No.: 10/412,507

(22) Filed: Apr. 14, 2003

(65) Prior Publication Data

US 2004/0201369 A1 Oct. 14, 2004

(51) Int. Cl.[7] ..... G05F 1/40
(52) U.S. Cl. ..... 323/281; 323/266
(58) Field of Search ..... 323/282, 283, 323/273, 303, 276, 281, 270, 274, 266; 257/358, 257/135, 606, 538, 678; 438/309, 210, 19, 438/275

(56) References Cited

U.S. PATENT DOCUMENTS

| | | | | |
|---|---|---|---|---|
| 4,319,179 | A * | 3/1982 | Jett, Jr. | 323/281 |
| 5,867,015 | A | 2/1999 | Corsi et al. | |
| 6,005,378 | A | 12/1999 | D'Angelo et al. | |
| 6,157,176 | A * | 12/2000 | Pulvirenti et al. | 323/266 |
| 6,246,221 | B1 | 6/2001 | Xi | |
| 6,300,749 | B1 * | 10/2001 | Castelli et al. | 323/273 |
| 6,459,321 | B1 | 10/2002 | Belch | |
| 6,501,253 | B2 * | 12/2002 | Marty | 323/280 |
| 6,549,156 | B1 * | 4/2003 | Moser | 341/144 |
| 6,608,520 | B1 * | 8/2003 | Miyazaki | 327/540 |

* cited by examiner

*Primary Examiner*—Rajnikant B. Patel
(74) *Attorney, Agent, or Firm*—Robert F. Hightower

(57) ABSTRACT

A voltage regulator (10) is formed to generate a compensation current to flow when an output voltage of the voltage regulator (10) exceeds a compensation value. The compensation current is at least equal to the leakage current of the output transistor (24).

19 Claims, 2 Drawing Sheets

METHOD OF FORMING A LOW QUIESCENT CURRENT VOLTAGE REGULATOR AND STRUCTURE THEREFOR

BACKGROUND OF THE INVENTION

The present invention relates, in general, to electronics, and more particularly, to methods of forming semiconductor devices and structure.

In the past, the semiconductor industry utilized various methods and structures to implement voltage regulators including linear voltage regulators. During normal operation, when the output voltage that was generated by the voltage regulator reached a desired operating value the voltage regulator disabled the output transistor. The output transistor remained disabled until such time as the output voltage decreased to a value that was below the desired operating value. An external filter capacitor and a load typically were connected to the output of the regulator. During the time that the output transistor was disabled, leakage current from the output transistor would flow through the external filter capacitor and continue to charge the filter capacitor. The leakage current charged the capacitor and the voltage on the capacitor increased in value and could reach a value that would cause damage to the load. In some cases, a resistor was connected between the output transistor and ground so that the leakage current from the transistor would flow through the resistor and not flow through the filter capacitor. One problem with such configurations was power dissipation. The leakage current flowing through the resistor increased the quiescent current consumption and, correspondingly, the power dissipation of the voltage regulator. Typically, the average quiescent current consumption of a voltage regulator using such a resistor configuration was no less than about fifty-five micro-amps.

Accordingly, it is desirable to have a method of forming a voltage regulator that reduces quiescent current consumption, and that maintains the output voltage below a value that damages the load.

For simplicity and clarity of illustration, elements in the figures are not necessarily to scale, and the same reference numbers in different figures denote the same elements. Additionally, descriptions and details of well known steps and elements are omitted for simplicity of the description. As used herein current carrying electrode means an element of a device that carries current through the device such as a source or a drain of an MOS transistor or an emitter or a collector of a bipolar transistor, and a control electrode means an element of the device that controls current through the device such as a gate of an MOS transistor or a base of a bipolar transistor.

DETAILED DESCRIPTION OF THE DRAWINGS

Figure 1:
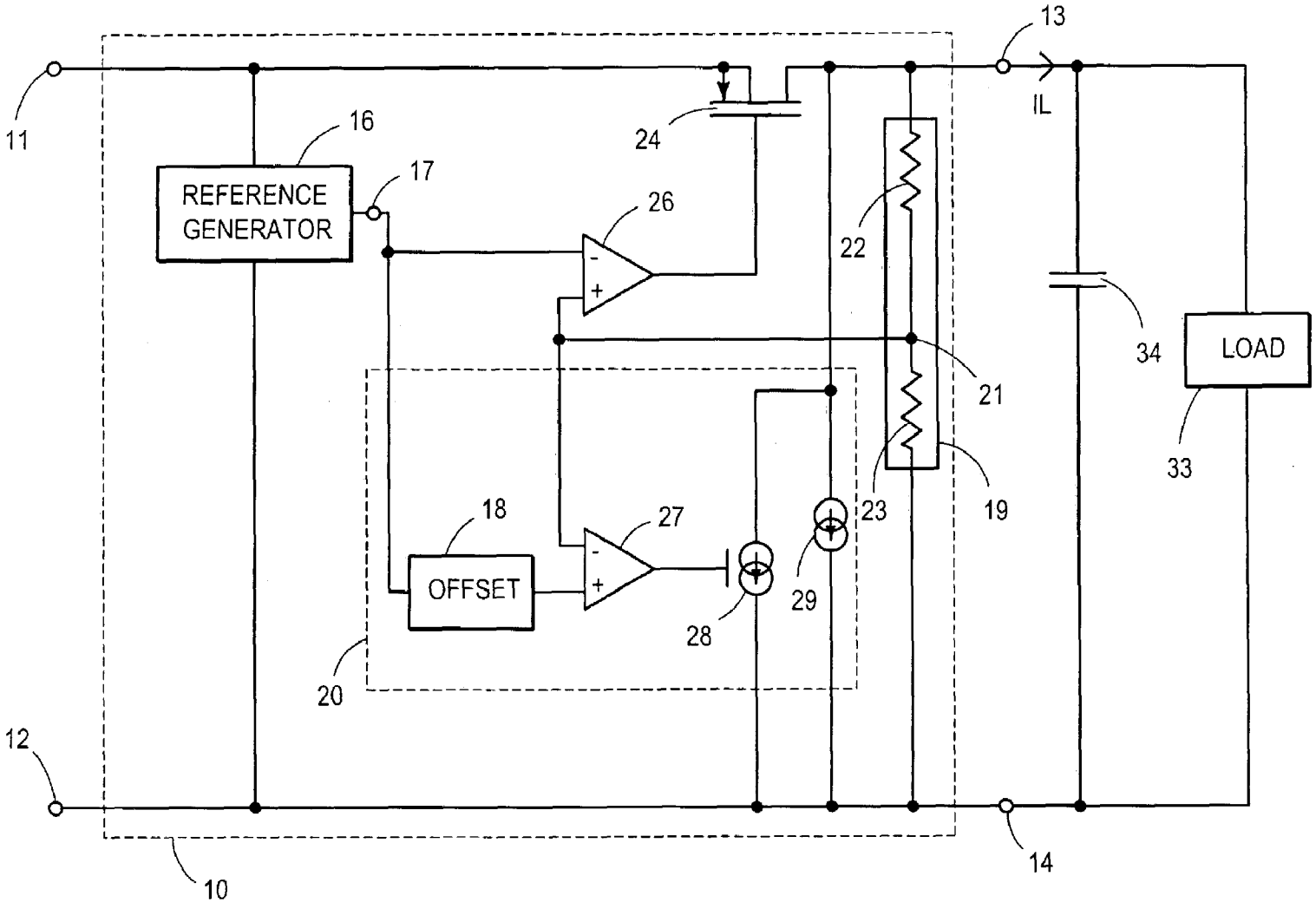
FIG. 1 schematically illustrates a portion of an embodiment of a voltage regulator in accordance with the present invention.

FIG. 1 schematically illustrates a portion of an embodiment of a voltage regulator 10 that has low quiescent current consumption and low power dissipation. Regulator 10 receives power from an external source on a power input 11 and a power return 12, and provides an output voltage between a voltage output 13 and a voltage return 14. A filter capacitor 34 and a load 33 are connected externally to regulator 10 between output 13 and return 14. Regulator 10 includes an error amplifier 26, an output device or output transistor 24, a feedback network 19, and a reference generator 16. Network 19, identified generally by a dashed box, includes a pair of feedback resistors 22 and 23 connected in series between output 13 and return 14 to form a resistor divider with a feedback node 21 formed by the connection of resistor 22 to resistor 23. Error amplifier 26 receives a feedback voltage from node 21 and a reference voltage from an output 17 of reference generator 16. Amplifier 26 receives the reference voltage and the feedback voltage and responsively generates an error voltage on an output of amplifier 26. Regulator 10 uses the error voltage to drive transistor 24 in order to control the value of the output voltage to a desired operating voltage. The desired operating voltage is established by the value of the voltage divider and the value of the reference voltage. Those skilled in the art understand that a desired operating voltage typically has a desired operating range that includes upper and lower limits. For example, a desired operating voltage value of two and one-half volts (2.5 V) may include a desired operating range that includes upper and lower limits that are plus or minus two per cent (±2%). Thus, the desired operating voltage range would have a typical value of about 2.5 volts, a maximum value of about 2.55 volts, and a minimum value of about 2.45 volts. When the value of the output voltage is less than the typical value, the value of the feedback voltage is less than the value of the reference voltage and error amplifier 26 forms an error voltage that enables transistor 24. Transistor 24 supplies a load current IL that flows through load 33 and capacitor 34, and charges capacitor 34 to increase the output voltage to the desired operating value. When the value of the output voltage reaches the desired operating value, the feedback voltage is higher than or equal to the reference voltage value on output 17 and error amplifier 26 generates an error voltage value that disables transistor 24. The features and operation of network 19, generator 16, amplifier 26, and transistor 24 are well known to those skilled in the art.

Regulator 10 also includes a compensation circuit 20, identified generally by a dashed box, that assists in reducing the quiescent current and power dissipation of regulator 10. Circuit 20 includes a selectable current source 28, a fixed current source 29, a compensation comparator 27, and a reference offset 18. Regulator 10 is formed to selectively enable selectable current source 28 to generate a compensation current that flows from transistor 24, through source 28, and to return 12 when the value of the output voltage equals or is greater than a first voltage value or compensation voltage value. Typically the value of the compensation voltage is greater than the maximum value of the desired operating voltage range and less than the value that may damage load 33. As will be seen hereinafter, offset 18 forms an offset reference voltage that is equal to the value of the reference voltage from generator 16 plus an offset voltage value. Comparator 27 receives the offset reference value and the feedback voltage and responsively enables or disables selectable current source 28.

Fixed current source 29 sinks a fixed value of current from transistor 24. This fixed value of current generally is formed to be about the value of leakage current that is expected from transistor 24 under typical process conditions and typical operating conditions including temperature. Under typical operating and process conditions, when transistor 24 is disabled source 29 sinks the leakage current from transistor 24 and no leakage current from transistor 24 flows through capacitor 34 or load 33. However, if the process conditions used to form transistor 24 vary from typical process parameters or if the operating conditions vary from typical operating conditions, when transistor 24 is disabled the leakage current of transistor 24 will exceed the current sunk by fixed source 29. This extra leakage current or excess leakage current is greater than the leakage current that can be sunk by fixed source 29 and will flow through capacitor 34. The excess leakage current begins to charge capacitor 34 resulting in an increase in the value of the output voltage. The output voltage increases until reaching the compensation value established by the value of the offset reference voltage from offset 18 and the feedback voltage. Compensation comparator 27 receives the feedback voltage and the offset reference voltage, and responsively enables source 28 when the value of the output voltage reaches the value of the compensation voltage. The compensation current plus the fixed current should be at least equal and preferably greater than the worst case leakage current of transistor 24. In the preferred embodiment, the compensation current alone is established to be at least equal to or greater than the worst case leakage current of transistor 24. This provides a safety margin for variations in the worst case leakage current. Enabling source 28 to sink the excess leakage current prevents the value of the output voltage from increasing beyond the compensation value and prevents damage to load 33. Selectively enabling source 28 to sink the excess leakage current reduces the quiescent current consumption of regulator 10 since source 28 only is enabled to sink current when the output voltage exceeds the value of the compensation voltage, thus, source 28 is not always enabled.

Comparator 27 typically is formed to have hysteresis to ensure that selectable current source 28 does not oscillate back-and-forth between being enabled and being disabled. In the preferred embodiment, comparator 27 has twenty milli-volts of hysteresis so that comparator 27 enables source 28 when the feedback voltage is equal to or greater than greater than the value of the offset reference voltage and disables source 28 when the value of the feedback voltage is twenty milli-volts less than the value of the offset reference voltage.

It should be noted that in some embodiments source 29 may be omitted however the output voltage may oscillate between the desired voltage value and the compensation voltage value even under typical conditions. However, the resistor divider of resistors 22 and 23 may be formed to provide the fixed current value and fixed current source 29 may be omitted. In other embodiments, comparator 27 may be replaced by an amplifier that selectively enables source 28 to form a compensation current responsively to the analog output signal of the amplifier. Additionally, regulator 10 may also include other well known circuit functions including over-current protection and temperature protection. Such circuits are not shown in FIG. 1 for clarity of the explanation.

In one example, regulator 10 was formed to have a typical desired operating value of approximately two and one-half volts (2.5 V) plus or minus two per cent (±2%) resulting in a desired operating range of about 2.45 volts to about 2.55 volts. The maximum value of voltage that did not damage load 33 was a value of approximately 2.7 volts. The value of capacitor 34 was about one microfarad. The typical leakage current of transistor 24 was about two (2) micro-amps at approximately twenty-five degrees Celsius (25° C.) and typical process parameters. The worst case leakage current of transistor 24 at worst case process parameters and worst case operating conditions was approximately fifteen (15) micro amps. The value of the fixed current was selected to be equal to the typical leakage current or about two micro-amps. The value of the current that source 28 could sink was selected to be forty micro-amps to ensure that source 28 could sink all of the worst case leakage current of transistor 24. However the actual current sunk by source 28 was the actual value of the excess leakage current of transistor 24. The compensation voltage value was selected to be about two and six tenths volts (2.6 volts). The value of the offset voltage was one hundred milli-volts in order to ensure that the value of the output voltage of output 13 was no greater than one hundred milli-volts higher than the desired operating value of 2.5 V. When the output voltage on output 13 reached a value of approximately 2.5 V, amplifier 26 disabled transistor 24 to maintain the output voltage at this value. As the value of the leakage current from transistor 24 exceeded two micro-amps, the value of the voltage on capacitor 34 increased to a value of about 2.6 volts and comparator 27 enabled selectable current source 28 to sink the excess leakage current from transistor 24. The value of the voltage on capacitor 34 slowly decreased to a value that was less than 2.6 volts and the output of comparator 27 once again disabled source 28. During the evaluation of this example circuit, in one period of time that transistor 24 was disabled source 28 was disabled for about two (2) milliseconds while capacitor 34 was charging and was enabled about six hundred fifty (650) micro-seconds while capacitor 34 discharged, thus, source 28 was enabled about twenty-five per cent (25%) of the time that transistor 24 was disabled. In this example, the average quiescent current of regulator 10 was about thirty-five micro-amps which is thirty-six per cent (36%) less than the fifty-five micro-amp average quiescent current of prior regulators. In some applications for example, battery operated applications, this current saving is very important.

Figure 2:
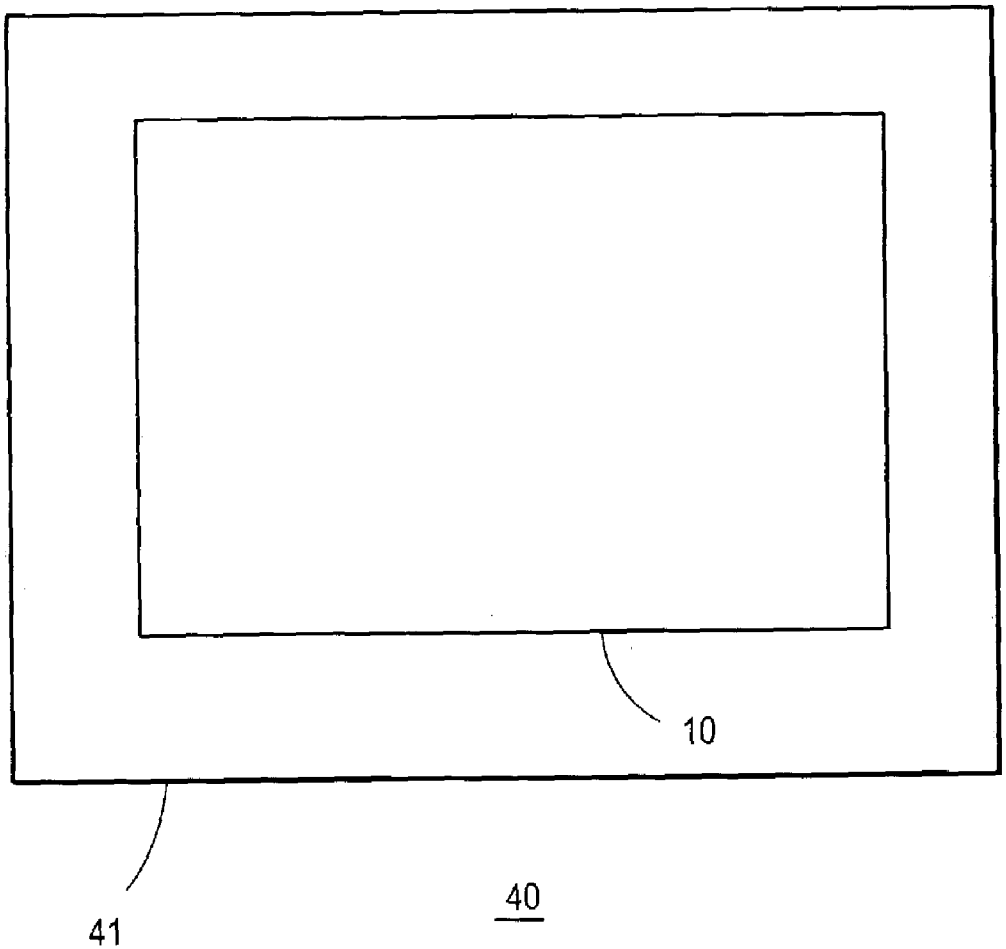
FIG. 2 schematically illustrates a portion of an embodiment of a semiconductor device that includes the voltage regulator of FIG. 1 in accordance with the present invention.

FIG. 2 schematically illustrates an enlarged plan view of a portion of an embodiment of a semiconductor device 40 that is formed on a semiconductor die 41. Regulator 10 is formed on die 41. Die 41 may also include other circuits that are not shown in FIG. 2 for simplicity of the drawing.

While the invention is described with specific preferred embodiments, it is evident that many alternatives and variations will be apparent to those skilled in the semiconductor arts. For example, the offset reference voltage may be formed elsewhere including formed as a separate output of generator 16. Comparator 27 may be an analog amplifier instead of a comparator. Additionally, fixed current source 29 may be omitted. Also, the invention has been described for a particular P-channel output transistor, although the method is directly applicable to other MOS transistors, as well as to bipolar transistors, BiCMOS, metal semiconductor FETs (MESFETs), HFETS, and other transistor structures.

In view of all of the above, it is evident that a novel method and device is disclosed. Included, among other features, is forming a voltage regulator to selective generate a compensation current to flow in order to prevent leakage current from an output transistor from increasing the output voltage of the voltage regulator to a value that may damage a load. Selectively enabling the current to flow reduces the quiescent current consumption of the regulator.

What is claimed is:

1. A method of forming a voltage regulator comprising:

forming the voltage regulator to provide an output voltage having a first value and a load current on a voltage output; and forming the voltage regulator to selectively generate a compensation current to flow from an output device of the voltage regulator to a voltage return of the voltage regulator but not through the voltage output wherein the voltage regulator is configured to selectively generate the compensation current after the output device is disabled and when the output voltage of the voltage regulator exceeds a second value that is greater than the first value.

2. The method of claim 1 wherein forming the voltage regulator to selectively generate the compensation current includes disabling the compensation current when the output voltage decreases to a third value that is less than the second value and greater than the first value.

3. The method of claim 1 wherein forming the voltage regulator to selectively generate the compensation current to flow includes forming the voltage regulator to selectively generate the compensation current to flow through the output device but not flow through an external load or through an external filter capacitor.

4. The method of claim 1 wherein forming the voltage regulator to generate the compensation current to flow includes forming the voltage regulator to enable a current source to generate the compensation current.

5. The method of claim 4 wherein forming the voltage regulator to generate the compensation current to flow includes forming the voltage regulator to enable the current source when the output voltage of the voltage regulator exceeds the first value.

6. The method of claim 5 further including forming the voltage regulator to disable the current source when the output voltage of the voltage regulator decreases to a second value that is less than the first value.

7. The method of claim 1 wherein forming the voltage regulator to generate the compensation current to flow includes forming the voltage regulator to generate a feedback voltage that is representative of the output voltage and coupling the voltage regulator to compare the feedback voltage to a first reference voltage value to generate the output voltage and coupling the voltage regulator to compare the feedback voltage to a second reference voltage having a value that is greater than a first reference voltage value to generate the compensation current to flow.

8. A method of forming a regulated voltage comprising:

generating an output voltage that has a desired operating range between a first desired value and a second desired value that is less than the first desired value;

disabling an output device when the output voltage reaches the first desired value; and selectively enabling a compensation current to flow from the output device to a voltage return when the output device is disabled and when the output voltage exceeds a compensation value that is greater than the first desired value.

9. The method of claim 8 further including disabling the compensation current when the output voltage decreases to another value that is less than the compensation value and greater than the first desired value.

10. The method of claim 8 wherein generating the output voltage includes coupling the output voltage to output terminals of a voltage regulator and wherein selectively enabling the compensation current to flow from the output device to the voltage return includes diverting current from flowing through the output terminals.

11. The method of claim 8 wherein selectively enabling the compensation current to flow includes enabling a current source to sink leakage current of the output device.

12. The method of claim 8 wherein selectively enabling the compensation current to flow includes forming a feedback voltage that is representative of the output voltage, comparing the feedback voltage to a first reference voltage for disabling the output device, comparing the feedback voltage to a second reference voltage that is larger than the first reference voltage and responsively enabling the compensation current to flow.

13. The method of claim 12 wherein comparing the feedback voltage to the second reference voltage that is larger than the first reference voltage and responsively enabling the compensation current to flow includes using a hysteresis comparator for comparing the feedback voltage to the second reference voltage.

14. The method of claim 12 wherein comparing the feedback voltage to the second reference voltage that is larger than the first reference voltage includes adding an offset voltage to the first reference voltage.

15. A voltage regulator comprising:

an output device coupled to receive an input voltage and form an output on an output of the voltage regulator;

a selectable current source coupled between the output device and a voltage return;

a feedback network coupled to form a feedback voltage that is representative of the output voltage;

an error amplifier coupled to receive a first reference voltage and the first reference voltage and responsively drive the output device; and a compensation amplifier coupled to receive the feedback voltage and a second reference voltage that is greater than the first reference voltage and responsively generate a compensation current to flow from the output device through the selectable current source to the voltage return but not through the output of the voltage regulator.

16. The voltage regulator of claim 15 wherein the compensation amplifier is a hysteresis comparator.

17. The voltage regulator of claim 15 wherein the compensation amplifier coupled to receive the feedback voltage and the second reference voltage that is greater than the first reference voltage and responsively generate the compensation current includes the compensation amplifier operably coupled to enable a current source to generate the compensation current.

18. The voltage regulator of claim 15 further including a fixed current source coupled to generate a fixed current to flow from the output device, wherein a value of the fixed current is approximately equal to a value of a leakage current of the output device.

19. A method of forming a voltage regulator comprising:

forming the voltage regulator to provide an output voltage having a first value and a load current on a voltage output; and forming the voltage regulator to selectively generate a compensation current to flow from an output device of the voltage regulator to a voltage return of the voltage regulator when the output voltage of the voltage regulator exceeds a second value that is greater than the first value including configuring a first current source to generate a first compensation current to flow through the output device to the first current source but not through the voltage output and also including configuring a selectable current source to generate the compensation current to flow through the output device.

* * * * *